US007172219B2

(12) United States Patent
Spragg et al.

(10) Patent No.: US 7,172,219 B2
(45) Date of Patent: Feb. 6, 2007

(54) SNOWBOARD UTILITY POLE

(75) Inventors: Justin M. Spragg, Encinitas, CA (US); Joseph M. Parker, La Jolla, CA (US)

(73) Assignee: Sparker International, Inc., Encinitas, CA (US)

( * ) Notice: Subject to any disclaimer, the term of this patent is extended or adjusted under 35 U.S.C. 154(b) by 0 days.

(21) Appl. No.: 10/957,051

(22) Filed: Oct. 1, 2004

(65) Prior Publication Data

US 2005/0104359 A1 May 19, 2005

Related U.S. Application Data

(60) Provisional application No. 60/508,669, filed on Oct. 2, 2003.

(51) Int. Cl.
*A63C 11/22* (2006.01)

(52) U.S. Cl. ..... 280/823; 280/819; 280/814

(58) Field of Classification Search ..... 280/819, 280/823, 814; 135/140, 142
See application file for complete search history.

(56) References Cited

U.S. PATENT DOCUMENTS

| | | | | |
|---|---|---|---|---|
| 1,621,255 | A | 3/1927 | Hunter | |
| 2,289,818 | A | 7/1942 | Winner et al. | |
| 2,490,183 | A | 12/1949 | Wheeler | |
| 2,690,211 | A * | 9/1954 | Wentz | 248/155.1 |
| 2,705,015 | A | 3/1955 | Langlais | |
| 2,757,011 | A | 7/1956 | Dormoy | |
| 2,818,290 | A | 12/1957 | Harocopo | |
| 3,378,272 | A | 4/1968 | Lewis | |
| 3,635,233 | A | 1/1972 | Robertson | |
| 3,712,652 | A * | 1/1973 | Uilkema | 403/108 |
| 3,722,903 | A * | 3/1973 | Jones | 280/823 |
| 3,730,544 | A * | 5/1973 | Hyman | 280/819 |
| 3,738,674 | A | 6/1973 | Pauls | |
| 3,797,845 | A | 3/1974 | Kepka et al. | |
| 3,868,122 | A | 2/1975 | Negi | |
| 3,885,805 | A | 5/1975 | Solymosi | |
| 3,948,535 | A | 4/1976 | Negi | |
| 4,114,911 | A | 9/1978 | Laird et al. | |
| 4,130,294 | A | 12/1978 | Walker | |
| 4,288,102 | A | 9/1981 | Ramer | |
| 4,332,399 | A | 6/1982 | Kepple | |
| 4,363,495 | A | 12/1982 | Henson | |
| 4,424,987 | A * | 1/1984 | Ryder | 280/823 |
| 4,593,933 | A | 6/1986 | Nunno | |
| 4,596,405 | A | 6/1986 | Jones | |
| 4,759,570 | A | 7/1988 | Dandy, III | |
| 4,793,627 | A | 12/1988 | Monreal | |
| 4,921,274 | A | 5/1990 | Holman | |
| 4,953,892 | A | 9/1990 | Adkins | |
| 5,110,154 | A | 5/1992 | Street | |
| 5,139,283 | A | 8/1992 | Dow et al. | |
| D349,144 | S | 7/1994 | Greene | |

(Continued)

*Primary Examiner*—J. Allen Shriver
(74) *Attorney, Agent, or Firm*—BioTechnology Law Group

(57) ABSTRACT

Embodiments include a collapsible utility pole that snowboarders can carry easily in their pants pocket and can be quickly pulled out and extended to a completely rigid pole to push themselves over flat sections of downhill runs. The utility pole can also being useful when getting off the chair lift to move toward the slopes. Embodiments of the device have the capability of being converted into a small shovel or ice pick by detaching the snow basket and attaching a desired device.

17 Claims, 4 Drawing Sheets

U.S. PATENT DOCUMENTS 5,451,078 A 9/1995 Ohata
5,941,435 A * 8/1999 Munro, III ..... 224/267
6,003,915 A * 12/1999 Bierman ..... 294/51
6,015,165 A * 1/2000 Artemis et al. ..... 280/824
6,027,087 A * 2/2000 Lindemann et al. ..... 248/188.5
6,029,998 A * 2/2000 Woodard ..... 280/819
6,217,072 B1 * 4/2001 Gregg ..... 280/823
6,217,073 B1 * 4/2001 Hoffman ..... 280/823
6,345,843 B1 * 2/2002 Barnes ..... 280/823
6,749,227 B2 * 6/2004 Margid ..... 280/823

* cited by examiner

SNOWBOARD UTILITY POLE

CROSS REFERENCE TO RELATED APPLICATIONS

This application claims priority under 35 U.S.C. section 119(e) from U.S. Provisional Patent Application Ser. No. 60/508,669, titled "SNOWBOARD UTILITY POLE", filed Oct. 2, 2003, by Justin M. Spragg and Joseph M. Parker, which is also incorporated by reference herein in its entirety.

BACKGROUND

Downhill skiing has been an established and popular winter sport for many years, but snowboarding is a relatively new innovation to the sport. Riding a snowboard down hill is similar to the ride and action of a surfboard on water. A snowboarder does not utilize ski poles and relies on the ability of shifting his weight from side to side and backwards and forwards to control the speed and direction of travel. At the end of a run, a snowboarder typically disengages the back or rear foot from the rear binding and advances to a chairlift or other destination by sliding the board forward with his front foot attached to the front binding and pushing with the back foot or performing the arduous task of removing both feet from the snowboard and walking through the snow. Oftentimes a snowboarder will become stalled in short flat areas between sloped sections of down hill runs and requires some means to push himself and get moving again.

A typical snowboard is a single board curved up at both ends and wider than a normal ski with a pair of boot bindings mounted on the board. Normally the binding for either the left foot or the right foot is located toward the front end of the snowboard and a binding for either the right foot or left foot is located toward the rear of the snowboard, with neither being directly parallel to the snowboard. The foot configuration is dependent on a snowboarder's stance preference. Normal ski poles are not used by snowboarders due to the rapid turning and manipulations required along with the stance the individual takes when engaged in the activity. Two poles would definitely not be suitable to the side stance of a snowboarder and a single long pole which cannot be quickly stowed would interfere with a snowboarder's ability to get into the bent knee or crouching position normally used on a downhill run.

Additionally, individuals in winter sports activities find the need for other tools and devices but have no place to carry or store them. Thus, there is a continuing need for improvement in the equipment used in the popular winter sports field.

SUMMARY

One embodiment includes a collapsible and portable utility pole having a telescoping body with a plurality of nested elongate segments. The elongate segments are configured in a telescoping arrangement with tapered portions at ends of adjacent elongate segments which are configured to produce a taper lock junction between adjacent segments when the adjacent segments are engaged. The taper lock junction gives the utility pole a mechanically rigid structure in an extended state.

Another embodiment includes a portable collapsible utility pole, having a plurality of elongate segments of differing transverse dimensions relative to each other which are slidably disposed within each other in a telescoping assembly. A distal most elongate segment has a coupler member disposed on a distal end thereof which is configured to detachably secure an accessory thereto. A proximal most elongate segment has a handle member disposed on a proximal end portion thereof. At least one junction between adjacent elongate segments has a tapered male portion which is configured to couple to a tapered female portion of an adjacent elongate segment by friction in order to produce a rigid joint between adjacent elongate segments.

In another embodiment, a portable collapsible utility pole, includes a plurality of elongate segments of differing transverse dimensions relative to each other and slidably disposed within each other in a telescoping assembly. A first elongate segment has a tapered male portion disposed on an end portion thereof. A second elongate segment is slidably disposed about the first elongate segment and has a female tapered portion disposed on an end portion thereof. There is a releasable junction between the first and second elongate segments including the tapered male portion coupled to the tapered female portion by friction in order to produce a rigid joint between adjacent segments and having an axial interlock member positioned on one of the elongate segments to mechanically lock the elongate segments in an extended state and mechanically prevent axial contraction between the first and second elongate segments.

These features of embodiments will become more apparent from the following detailed description when taken in conjunction with the accompanying exemplary drawings.

DETAILED DESCRIPTION

Embodiments of the invention relate to the field of winter sports activities; more specifically to a tapered telescoping snowboard pole which quickly extends to propel snowboarders over flat terrain after loosing forward momentum while traveling down a slope. Additional utilitarian features may be removably secured to embodiments of the utility pole such as a small shovel and an ice pick, along with a conventional snow basket or a collapsible snow basket mounted to an optional coupler member on the utility pole's distal end. Embodiments of the invention can include the features of quickly extending to its fully expanded state or position to enable snowboarders to maintain their forward momentum while traveling over flat terrain, of fitting conveniently into a pants pocket on the lower leg or a jacket pocket, of being a much stronger snowboard utility pole by using a tapered locking means, having a tapered locking means along with a detent positioning engagement means, having a unique folding snow basket end or other accessories for other uses that can be easily stored.

Embodiments of the present invention create a continuous rigid structure when fully extended. Segments of the utility pole can be tapered and include optional internal plugs at the unions or junctions of the utility pole segments insuring that when the pole is fully extended each segment creates a taper lock joint with an overlapping portion of an adjacent adjoining segment to form a continuous rigid structure. A spring-loaded ball detent, when positioned into a reinforced detent engagement unit, may be used to assure that the utility pole embodiment will not collapse when an amount of axial pressure sufficient to dislodge the taper lock joint is exerted down on the pole. In other embodiments, the function of axial stability and lateral stability are carried out separately by the components of the joint or joints between adjacent pole segments. In such an embodiment, the taper lock joint can be configured to prevent wobbling or relative lateral motion between adjacent segments and the ball detent, or other suitable mechanical locking device, can be used to support the primary axial load on the utility pole when the pole is in an extended state.

One embodiment includes a utility pole that is extremely rigid when fully extended, expands to the fully extended position very quickly, and has the capability of attaching a variety of different devices such as a shovel and an ice pick along with a conventional snow basket or a collapsible snow basket. An embodiment of the collapsible snow basket can collapse like an umbrella to fit easily into a user's pocket. Embodiments of the attachments may thread onto a coupler member at the distal end of a lower elongate segment or section of the utility pole.

Figures 1, 2:
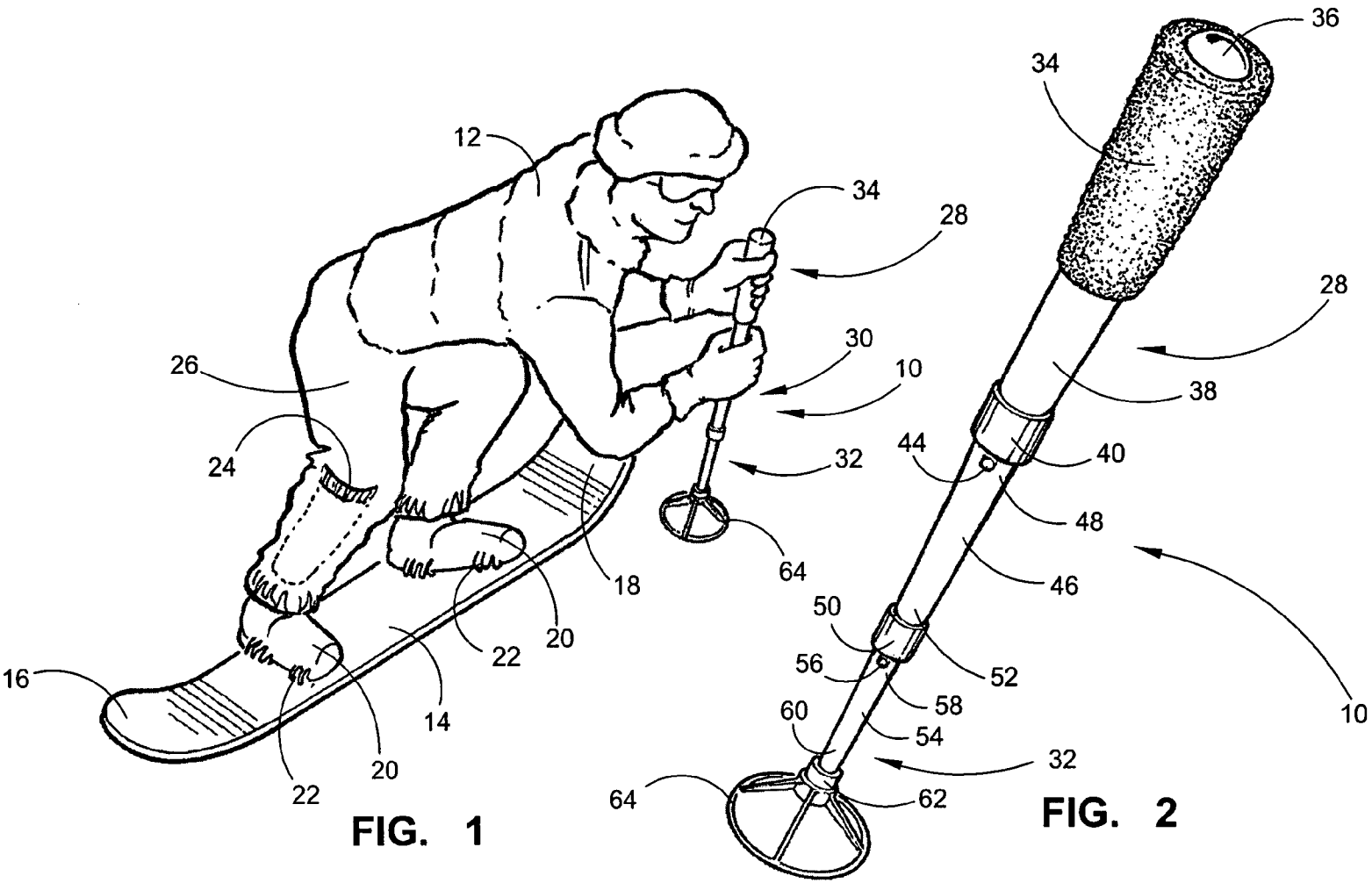
FIG. 1 depicts a perspective view of an individual on a snowboard using an embodiment of a utility pole to push himself over flat sections of snow-covered slopes.
FIG. 2 depicts a perspective view of a utility pole embodiment in an extended state.

Referring now to the drawings, there is seen in FIG. 1 an individual 12 on a snowboard 14 using an embodiment of a utility pole 10 in the extended position to push himself over a flat section of a snow covered slope. The snowboard 14 is commonly curved upwardly at the ends 16 and 18 and attached to the boots 20 of the individual 12 by the means of conventional bindings 22. A storage pocket 24 may be located in the lower leg of the pants 26 of the individual 12 on the snowboard 14 for storing the utility pole 10.

FIG. 2 shows the utility pole 10 in the extended state. This perspective view depicts the utility pole 10 having three tubular elongate segments with a substantially circular or circular transverse cross section; an upper or proximal elongate segment 28, a central or intermediate elongate segment 30 and a lower or distal elongate segment 32. Alternate embodiments of the utility pole 10 may include two, three, four, five or more elongate segments, any of which may be circular or non-circular in transverse cross section, including square, triangular and other transverse cross sections. The elongate segments 28, 30 and 32 may be constructed of a variety of different materials such as aluminum, steel, graphite, carbon fiber, or fiberglass and the like.

The upper elongate segment 28 consists of a cushioned handgrip 34, end cap 36, tapered body 38 and the reinforced detent engagement unit 40. The reinforced detent engagement unit 40 may be made of a metal material, such as aluminum, steel or brass. The central or intermediate tapered segment 30 includes the tapered body 46 with the spring-loaded ball detent 44 at the upper or proximal end 48 and the reinforced detent engagement unit 50 at the lower or distal end 52. The reinforced detent engagement unit 40 in conjunction with the cooperating spring loaded ball detent 44 form an embodiment of an axial interlock mechanism which mechanically prevents axial collapse or compression of the upper elongate segment 28 and the intermediate elongate segment 30. The particular arrangement of the reinforced detent engagement unit 40 and spring-loaded ball detent 44 prevents axial collapse of the upper elongate segment 28 and intermediate elongate segment 30, but also allows for relative rotational or twisting movement between the elongate segments 28 and 30 in order to faciliate release of the junction between the elongate segments 28 and 30. The same configuration exists for the junction between the intermediate elongate segment 30 and distal or lower elongate segment 32.

The lower segment 32 consists of a tapered body 54 with a spring-loaded ball detent 56 at the upper end 58 configured to engage the reinforced detent engagement unit 50 disposed on the distal end of the intermediate segment 30. The distal end 60 of the lower segment 32 incorporates an optional coupler member 62 which is configured to releasably secure a variety of attachment. A snow basket 64 is attached to the coupler member 62 by screwing a threaded portion of the coupler member 62 to a mating threaded portion of the snow basket 64. Although the three elongate segments 28, 30 and 32 are depicted as being tapered over their entire length, other embodiments may be tapered over only longitudinal portions of the segments 28, 30 and 32, such as the longitudinal end portions of the segments.

Figure 3:
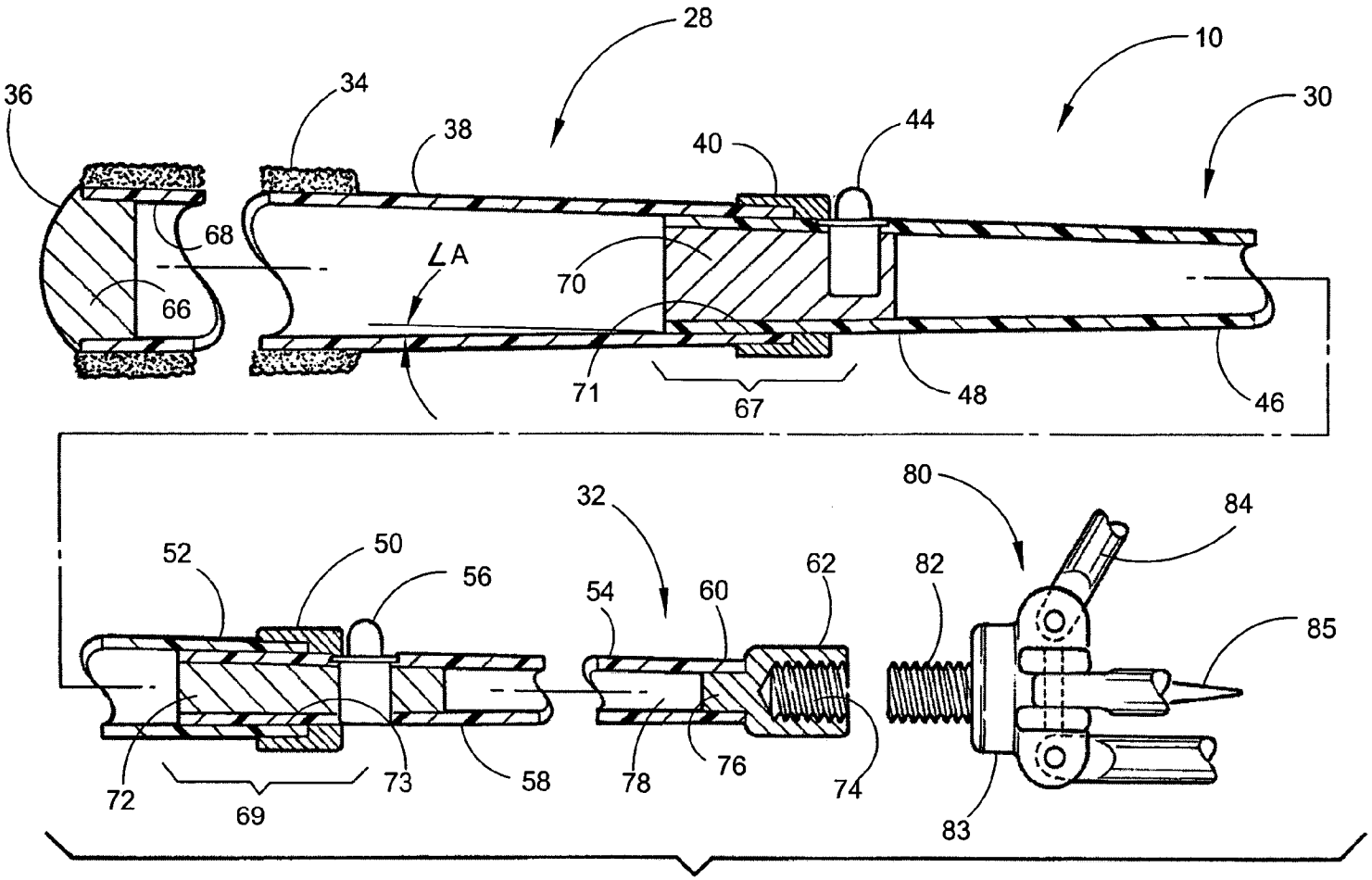
FIG. 3 depicts a section through an embodiment of a utility pole indicating internal mechanisms.

FIG. 3 is a sectional view of utility pole 10 indicating internal mechanisms of the utility pole 10. The end cap 36, which provides a smooth rounded contour to the proximal end of segment 28, is attached by the means of inserting a mating portion 66 within an internal portion 68 of the tapered body 38. A wide variety of conventional cushioned handgrips 34 will be available to be attached by the means of adhesive to the exterior surface of the tapered body 38.

At the distal end of the upper tapered segment 28 the reinforced detent engagement unit 40 is secured by means of adhesive, but may also be threaded onto segment 28 or secured by any other suitable method. Overlapping portions of the segments 28, 30 and 32 when the utility pole 10 is in an extended state include taper lock junction portions 67 and 69 which produce taper lock junctions 71 and 73, respectively. The taper lock junction 71 between the proximal end of the intermediate segment 30 and the distal end of the proximal segment 28 prevents lateral movement of the joint between the segments because of the frictional force between the outside surface of the intermediate segment 30 and an inside surface of the proximal segment 28 in the overlapped taper lock junction portion 67.

The angle A of taper locked junction portions 67 and 69 of the utility pole 10, shown in FIG. 3, may be less than about 7 degrees and will assume a locking tapered fit that prevents or resists lateral movement or bending between adjacent segments 28, 30 and 32 when fully extended, creating a very rigid device 10. In other embodiments, the angle of taper A may be about 2 to about 10 degrees, more specifically, about 3 to about 7 degrees. In yet another embodiment, the angle A may be from about 1 degree to about 5 degrees, more specifically, from about 2 degrees to about 4 degrees. The angle A shown in FIG. 3 is formed between a wall surface of a tapered segment and a longitudinal axis of the tapered segment. Although the taper lock junctions 71 and 73 resist lateral movement when in a locked or axially extended state with the taper lock junction surfaces engaged by friction, the locked position is reversible by applying a sufficient compressive axial force in order to overcome the frictional force between the junction portions of the respective segments. As discussed above, the particular arrangement of the reinforced detent engagement unit 40 and spring-loaded ball detent 44 prevents axial collapse of the upper segment 28 and intermediate segment 30, but also allows for relative rotational or twisting movement between the segments 28 and 30. The disengagement of adjacent elongate segments may be facilitated by imparting a relative twisting or rotational movement between adjacent elongate segments 28, 30 and 32. The same configuration exists for the junction between the intermediate segment 30 and distal or lower segment 32. This allows for the convenient collapse of the utility pole 10 for storage by the user when not needed.

Although the taper lock junctions 71 and 73 provide some resistance to axial collapse of the pole 10 when in an extended state, it may be desirable to have an axial interlock mechanism to prevent unwanted axial collapse of the pole 10, particularly when it is anticipated that large amounts of axial force may be applied to the utility pole 10. Longitudinal collapse of embodiments of the utility pole 10 due to application of axial force along a longitudinal axis of the utility pole 10 may ultimately be prevented by optional axial interlock mechanisms in the form of spring ball detents or the like. FIG. 3 shows spring ball detents 44 and 56 mechanically engaging the reinforced detent engagement units 40 and 50, respectively, and mechanically preventing axial collapse of adjacent segments 28, 30 and 32. Optional internal plugs 70 and 72 affixed by pressed fit by welding, adhesive bonding or the like, within the upper ends 48 and 58 of central tapered segment 30 and the lower tapered segment 32, respectively, can add additional structural support to the device when it is fully extended. In addition, the internal plugs 70 and 72 can act as a base for attachment of the spring loaded ball detents 44 and 56, or any other suitable mechanism used to lock the segments 28, 30 and 32 into an extended configuration. The coupling unit 62 with an internal thread 74 is attached to the distal end 60 by inserting the reduced section 76 into the internal cavity 78 of the lower tapered segment 32 and attached in a similar fashion as 70 and 72. A unique collapsible snow basket 80 is equipped with a threaded stud 82 to attach to the internal thread 74 of the coupling unit 62.

Figures 4, 5:
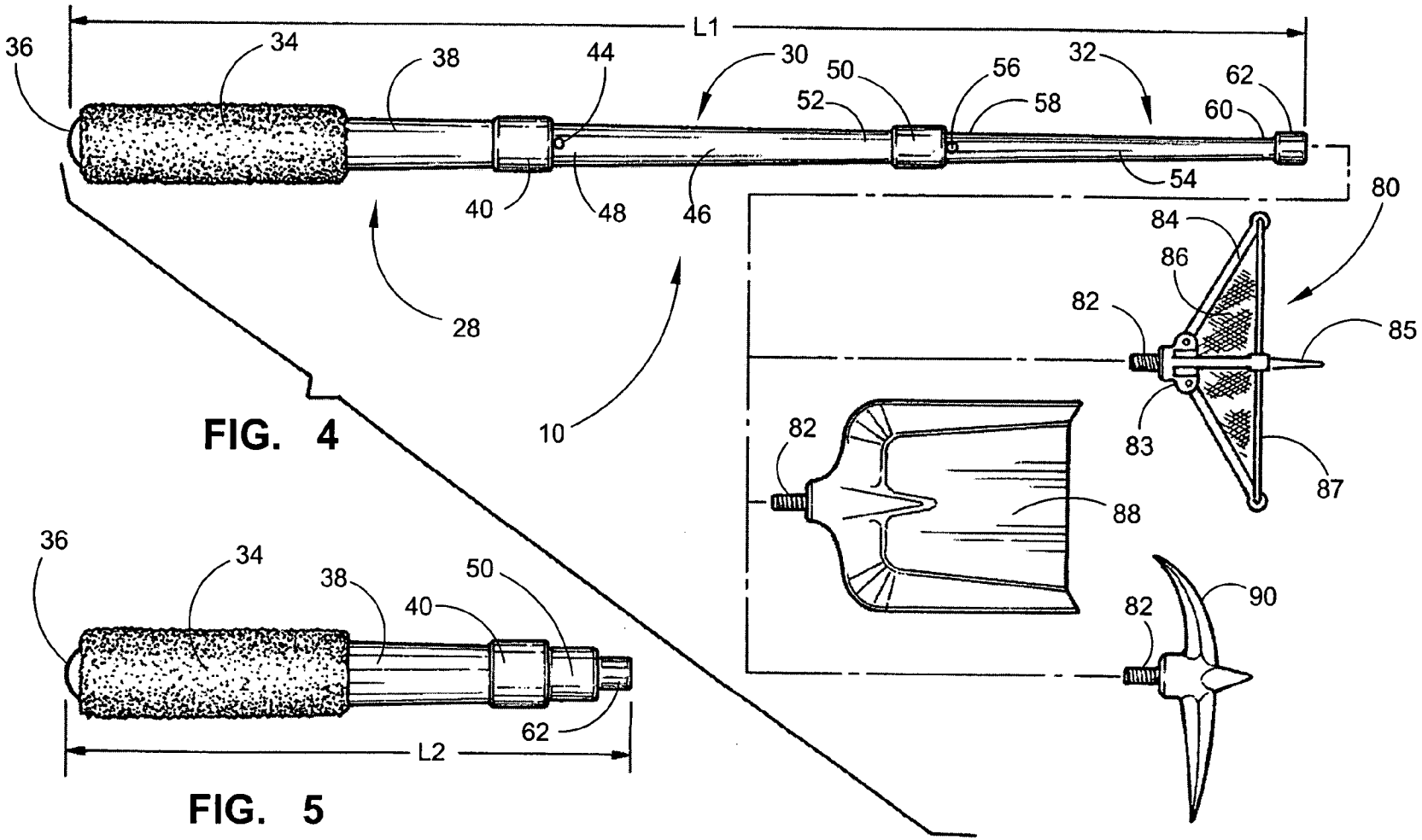
FIG. 4 depicts a plan view of an embodiment of a utility pole in an extended state with a basket, shovel and ice pick accessories exploded away.
FIG. 5 depicts a plan view of a utility pole in a compressed state.

FIG. 4 illustrates utility pole 10 in the extended state with a variety of adaptable fixtures and accessories. The conventional snow basket 64 or the collapsible snow basket 80 with its plurality of pivoting support arms 84 and mesh covering 86 will probably be the most used, while the shovel 88 and the ice pick 90 could be added features. The collapsible snow basket 80 has a center post 85 disposed along the longitudinal axis of the utility pole with a proximal end of the center post secured to a pivoting body 83 of the collapsible snow basket 80. The center post 85 optionally has a pointed tip in order to facilitate penetration of ice or hard frozen snow. The four pivoting support arms 84 are disposed about the center post 85 with proximal ends of the pivoting support arms 84 pivotally mounted to the pivoting body 83. A frame member 87 having a continuous looped structure is secured to the distal ends of the pivoting support arms and the wire mesh 86, or other suitable type of mesh or fabric, has a perimeter secured to the frame member so as to form a cupped structure to offer a wide surface area to push against snow.

The extended length L-1 of the utility pole 10 can vary due to the size of the individual 12 using the snowboard 14 and the number of tapered segments, with one embodiment having three segments and a total length of less than or equal to 36 inches in the extended state. In other embodiments, the extended axial length L-1 of the utility pole 10 can be about 18 inches to about 24 inches, more specifically, about 20 to about 22 inches. In yet another embodiment, the extended length L-1 of the utility pole 10 may be from about 18 inches to about 36 inches. As the individual 12 is normally in the crouched position there is no need for the utility pole 10 to be any longer than necessary to allow for propulsion of the individual 12, and the shorter the pole, the shorter the collapsed length. FIG. 5 shows the utility pole 10 in the compressed state having an axial length L-2 allowing it to fit easily into a pants pocket 24. In some embodiments of utility pole 10, the compressed axial length L-2 can be about 5 inches to about 10 inches. In another embodiment, the collapsed length L-2 of the utility pole 10 may be from about 5 inches to about 13 inches. When the utility pole 10 is in an extended state, such as illustrated in FIG. 4, the overlap between adjacent segments, such as between a distal portion of segment proximal portion of segment 30 can have an axial length of about 0.5 inch to about 2 inches, more specifically, about 0.75 inch to about 1.25 inches.

Figure 6:
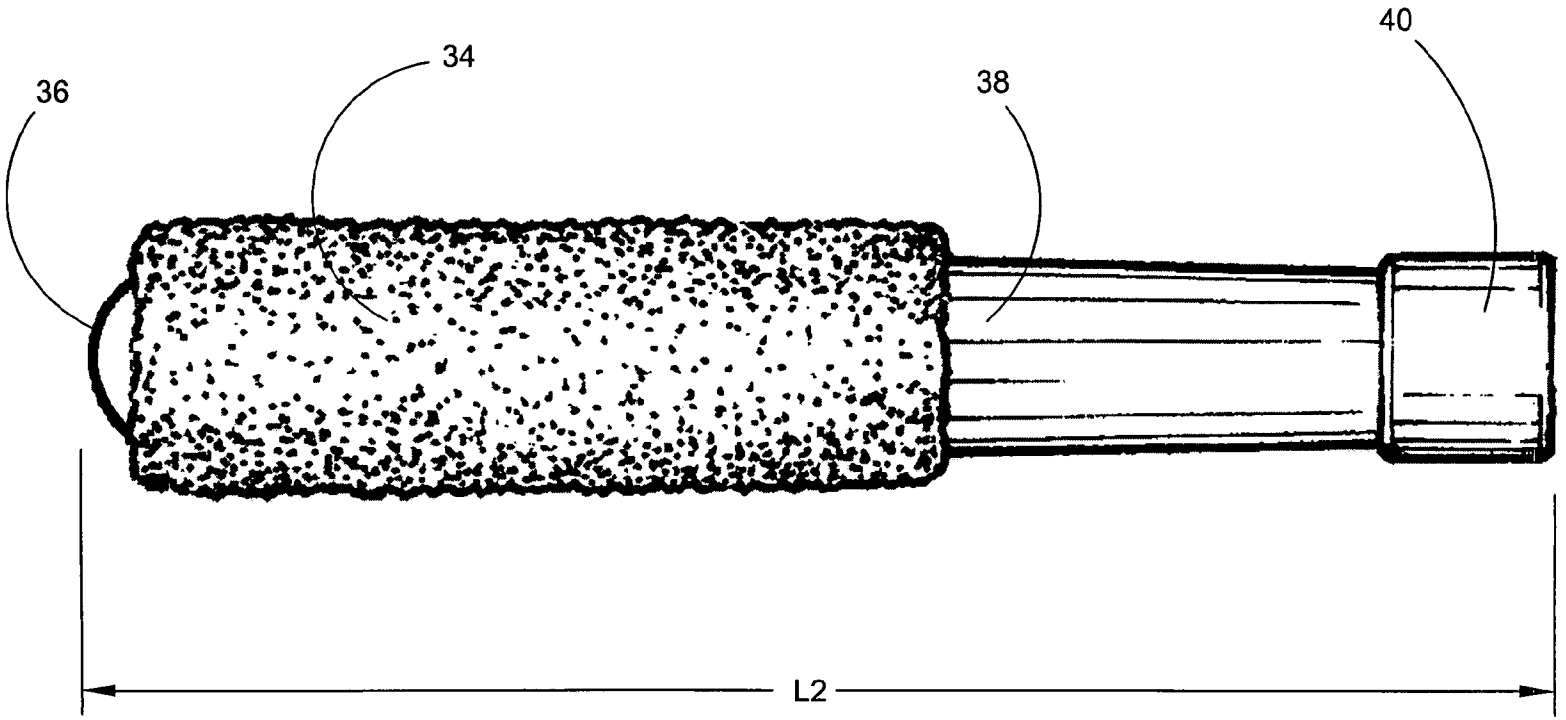
FIG. 6 illustrates an embodiment of a utility pole having multiple segments that collapse completely within a proximal most segment.

FIG. 6 illustrates an embodiment of a utility pole 10 having multiple segments 28, 30 and 32 wherein segments 30 and 32 collapse completely within the proximal most segment 28. In this configuration, the reinforced detent engagement unit 50 and coupler member 62 must be sized and configured to fit within an inner lumen of the distal end of elongate segment 28 and reinforced detent engagement unit 40. More specifically, the coupler member 62 must be configured to fit within an inner lumen of the distal end of elongate segment 30 and reinforced detent engagement unit 50. Reinforced detent engagement unit 50 must be configured to fit within an inner lumen of the distal end of elongate segment 28 and reinforced detent engagement unit 40. This configuration allows for a more complete collapse of the utility pole 10 for storage and provides a more compact collapsed state having lower values for L-2.

With regard to the above detailed description, like reference numerals used therein refer to like elements that may have the same or similar dimensions, materials and configurations. While particular forms of embodiments have been illustrated and described, it will be apparent that various modifications can be made without departing from the spirit and scope of the invention. Accordingly, it is not intended that the invention be limited by the forgoing detailed description.

What is claimed is:

1. A portable collapsible utility pole, comprising:

a plurality of elongate segments of differing transverse dimensions relative to each other and slidably disposed within each other in a telescoping assembly;

a distal most elongate segment having a coupler member which is configured to detachably secure an accessory thereto and which is disposed on a distal end thereof;

a proximal most elongate segment having a handle member disposed on a proximal end portion of the proximal most elongate segment; and at least one junction between adjacent elongate segments having a tapered male portion which is configured to releasably couple to a tapered female portion by friction in order to produce a rigid joint between the tapered male portion and tapered female portion of adjacent elongate segments in an extended state.

2. The utility pole of claim 1 wherein the at least one junction between adjacent elongate segments further comprises an axial interlock member positioned to mechanically lock the elongate segments in an extended configuration and mechanically prevent axial contraction of between the elongate adjacent segments.

3. The utility pole of claim 2 wherein the interlock member comprises a spring-loaded ball detent with a ball of the ball detent positioned to mechanically lock the elongate segments in an extended configuration and mechanically prevent axial contraction of between the adjacent elongate segments.

4. The utility pole of claim 1 wherein the plurality of elongate segments comprises at least one intermediate elongate segment disposed between and in a telescoping configuration between the proximal most elongate segment and distal most elongate segment.

5. The utility pole of claim 4 wherein the at least one intermediate elongate segment comprises about 1 to about 3 intermediate elongate segments disposed between and in a telescoping configuration between the proximal most elongate segment and distal most elongate segment.

6. The utility pole of claim 1 wherein the coupler member comprises a threaded portion.

7. The utility pole of claim 1 further comprising a snow basket attachment detachably secured to the coupler member.

8. The utility pole of claim 7 wherein the snow basket attachment comprises a collapsible snow basket attachment.

9. The utility pole of claim 1 further comprising a shovel attachment detachably secured to the coupler member.

10. The utility pole of claim 1 further comprising an ice pick attachment detachably secured to the coupler member.

11. A portable collapsible utility pole, comprising:

a plurality of elongate segments of differing transverse dimensions relative to each other and slidably disposed within each other in a telescoping assembly;

a first elongate segment having a tapered male portion disposed on an end portion thereof;

a second elongate segment slidably disposed about the first elongate segment and having a female tapered portion disposed on an end portion thereof;

a releasable junction between the first and second elongate segments with the tapered male portion coupled to the tapered female portion by friction in order to produce a rigid joint between adjacent segments in an extended state and having an axial interlock member positioned on one of the elongate segments to mechanically lock the elongate segments in an extended state and mechanically prevent axial contraction between the first and second elongate segments; and a coupler member configured to detachably secure an accessory thereto disposed on an end portion of one of the elongate segments.

12. The utility pole of claim 11 wherein the coupler member comprises a threaded portion.

13. The utility pole of claim 11 further comprising a snow basket attachment detachably secured to the coupler member.

14. The utility pole of claim 13 wherein the snow basket attachment comprises a collapsible snow basket attachment.

15. The utility pole of claim 11 further comprising a shovel attachment detachably secured to the coupler member.

16. The utility pole of claim 11 further comprising an ice pick attachment detachably secured to the coupler member.

17. The utility pole of claim 11 wherein the coupler member is disposed on an end of the first elongate segment.

* * * * *